US006630797B2

(12) United States Patent
Qian et al.

(10) Patent No.: US 6,630,797 B2
(45) Date of Patent: Oct. 7, 2003

(54) HIGH EFFICIENCY DRIVER APPARATUS FOR DRIVING A COLD CATHODE FLUORESCENT LAMP

(75) Inventors: Jinrong Qian, Croton-on-Hudson, NY (US); DaFeng Weng, San Jose, CA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/883,445

(22) Filed: Jun. 18, 2001

(65) Prior Publication Data

US 2002/0195971 A1 Dec. 26, 2002

(Under 37 CFR 1.47)

(51) Int. Cl.[7] ..... H05B 41/29
(52) U.S. Cl. ..... 315/224; 315/244; 315/DIG. 7
(58) Field of Search ..... 315/209 R, 219, 315/224, 225, 226, 244, 291, 307, DIG. 7, 239, 241 R

(56) References Cited

U.S. PATENT DOCUMENTS 5,495,405 A * 2/1996 Fujimura et al. ..... 363/133
5,886,477 A 3/1999 Honbo et al. ..... 315/209 PZ
5,914,843 A 6/1999 Hopkins et al. ..... 361/42
5,965,985 A 10/1999 Nerone ..... 315/DIG. 4
6,011,360 A 1/2000 Gradzki et al. ..... 315/244
6,134,132 A 10/2000 Janssen et al. ..... 363/132
6,317,347 B1 * 11/2001 Weng ..... 315/219
6,414,447 B1 * 7/2002 Kitamura et al. ..... 315/272

* cited by examiner

*Primary Examiner*—Hoang Nguyen
*Assistant Examiner*—Thuy Vinh Tran

(57) ABSTRACT

An inverter circuit for a gas discharge lamp having a primary circuit having a DC voltage supply, a transformer, a switching circuit including a first switch and a second switch for controlling a conduction state of the inverter circuit; a tank circuit having a resonant inductor and a resonant capacitor, the lamp load being coupled with the resonant capacitor; and a capacitor coupled to the first and second switches for maintaining a voltage across a primary winding of said transformer. Accordingly, the required turns ratio of the transformer is reduced by half which reduces the power loss in the transformer, thereby improving circuit efficiency. In addition, energy stored in a leakage inductance, which is otherwise dissipated across the switches of the push-pull switch configuration in the prior art, is recovered or captured by the clamping capacitor, thereby preventing the occurrence of voltage spikes across the switches.

18 Claims, 7 Drawing Sheets

HIGH EFFICIENCY DRIVER APPARATUS FOR DRIVING A COLD CATHODE FLUORESCENT LAMP

BACKGROUND OF THE INVENTION

1. Field of the Invention

The present invention relates to a device for driving a cold cathode fluorescent lamp (CCFL) used as a backlight of a liquid crystal display.

2. Description of the Related Art

Similar to a conventional hot-cathode fluorescent lamp ("FL") used for office and home lighting, CCFLs are high-efficiency, long-life light sources. By comparison, incandescent lamps have efficiency in the range of 15 to 25 lumens per watt, while both FLs and CCFLs have efficiency in the range of 40 to 60 lumens per watt. Furthermore, the average life of an incandescent lamp is only about 1,000 hours. However, FLs and CCFLs, on average, last for 10,000 hours or more.

The main difference between a hot-cathode FL and a CCFL is that the CCFL omits filaments that are included in a FL. Due to their simpler mechanical construction and high efficiency, miniature CCFLs are generally used as a source of back lighting for Liquid Crystal Displays ("LCDs"). LCDs, whether color or monochrome, are widely used as displays in portable computers and televisions, and in instrument panels of airplanes and automobiles.

However, starting and operating a CCFL requires a high alternating current ("ac") voltage. Typical starting voltage is around 1,000 volts AC ("Vac"), and typical operating voltage is about 600 Vac. To generate such a high ac voltage from a dc power source such as a rechargeable battery, portable computers and televisions, and instrument panels, include a dc-to-ac inverter having a step-up transformer.

In the push-pull configuration illustrated in FIG. 1, $L_{k1}$ and Lk2 are the leakage inductances of the transformer T, $D_{S1}$ and $C_{s1}$ are the body diode and internal capacitance of switch S1, respectively, and $D_{s2}$ and $C_{s2}$ are the respective body diode and internal capacitance of switch S2. Winding N3 is coupled with windings N1 and N2. Inductor Lr, is a resonant inductor including a leakage inductance of transformer T. Inductor Lr and capacitor Cr form a resonant tank to provide a high frequency voltage to the load, $R_o$.

FIGS. 2*a*–2*d* illustrate typical switching waveforms associated with the circuit of FIG. 1. Referring first to FIG. 2*a*, at the point in time when switch S1 is turned off (t0) energy stored in the leakage inductance $L_{k1}$ is released to charge the capacitance Cs1 which causes an undesirable voltage spike across switch S1, as illustrated in FIG. 2*c*. Another problem associated with the circuit configuration of FIG. 1 is that the high voltage spike requires that switches S1 and S2 have high voltage breakdown voltage ratings.

At time t1, the gate signal (See FIG. 2*b*) of switch S2 is applied allowing switch S2 to be turned on at zero voltage (not shown). S2 carries the primary winding current.

As shown in FIG. 2*d*, a second voltage spike occurs at time t2 at switch S2, the point at which switch S2 is turned off. This voltage spike is the result of the release of energy from the leakage inductance $L_{k2}$.

Referring now to FIG. 3, one prior art solution for eliminating or minimizing the undesirable voltage spikes is through the use of passive snubber circuits (R-C-D) for switch S1 and (R-C-D) for switch S2, respectively. The passive snubber circuits are designed to absorb the leakage energy of the transformer ($L_{k1}$, $L_{k2}$). An undesirable consequence of using snubber circuits is that the converter circuit has a lower conversion efficiency by virtue of having to dissipate the undesirable leakage energies.

Another type of conventional ballast, illustrated in FIG. 4, employs a half-bridge inverter circuit configuration. The half-bridge switching circuit includes switches S1 and S2, resonant inductor $L_r$ and resonant capacitor $C_r$. Inductor $L_r$ could represent the leakage inductance or a separate inductance in the case where the leakage inductance is insignificant. $C_r$ could represent a combination of the winding capacitance and shield capacitance of the lamp. $C_d$ represents a DC blocking capacitor. The input voltage, $V_{in}$, is typically around 12 V. Until the CCFL or load ($R_L$) is "struck" or ignited, the lamp will not conduct a current with an applied terminal voltage that is less than the strike voltage, e.g., the terminal voltage can be as large as 1000 Volts. Once an electrical arc is struck inside the CCFL, the terminal voltage may fall to a run voltage that is approximately ⅓ the value of the strike voltage over a relatively wide range of input currents. To achieve voltages on the order of 1000 volts, a high voltage gain of the resonant inverter is required in addition to a high turns ratio of the isolation transformer. However, given that the peak excitation voltage $V_x$ of the resonant tank is only one-half the input voltage, the resonant inverter voltage gain is restricted. Therefore, the only means of achieving a strike voltage on the order of 1000 volts is to require that the transformer have a very high turns ratio. This is problematic, however, in that a high turns ratio transformer is characteristically leaky and therefore not efficient.

Accordingly, it is desirable to provide an improved ballast which is more efficient in operation than a conventional ballast whether of the push-pull or half-bridge type while reducing or substantially eliminating spike voltages.

SUMMARY OF THE INVENTION

Accordingly, it is an object of the invention to provide an inverter circuit which eliminates or substantially reduces voltage spikes associated with switching elements in a push-pull switch configuration.

It is a further object of the invention to provide an inverter circuit which recovers leakage energy associated with an isolation transformer to improve circuit efficiency.

It is yet a further object of the invention to provide an inverter circuit which reduces the turns ratio of the isolation transformer to reduce power losses in the transformer to further improve circuit efficiency.

In accordance with an embodiment of the present invention, there is provided an inverter circuit and a method for efficiently converting a direct current (DC) signal into an alternating current (AC) signal for driving a load such as a cold cathode fluorescent lamp. The inverter circuit includes a resonant tank circuit having a resonant inductor and resonant capacitor and coupled via a transformer between a DC signal source and a common terminal of a half-bridge switch configuration. A voltage clamping capacitor is connected to a second and third terminal of the half-bridge switch configuration. A voltage difference between the capacitor voltage and the supply (i.e., input) voltage is applied to the terminals of the resonant tank. The voltage difference across the resonant tank is nominally twice the voltage of prior art configurations.

The inverter circuit according to the present invention includes a primary circuit having a DC voltage supply, a transformer coupling said primary and load circuits, a switching circuit comprising a first switch and a second switch for controlling a conduction state of said inverter circuit; a tank circuit having a resonant inductor and a resonant capacitor, the lamp load being coupled with the resonant capacitor; and a capacitor coupled to the first and second switches for maintaining a voltage across a primary winding of said transformer.

Accordingly, the required turns ratio of the transformer is reduced by half, as compared to prior art inverter circuits, thereby reducing the power loss in the transformer which improves circuit efficiency.

In accordance with another aspect of the present invention, the leakage energy stored in a leakage inductance associated with the transformer is recovered or captured by the clamping capacitor thereby preventing or substantially reducing the occurrence of voltage spikes across the switches which comprise the half-bridge switching configuration. As described above, in one prior art configuration, this leakage inductance, when released, charges a capacitance associated with the push-pull switches which causes voltage spikes across the switches. An additional advantage of capturing the leakage current is that the voltage ratings of the switches is significantly reduced.

BRIEF DESCRIPTION OF THE DRAWINGS

The foregoing features of the present invention will become more readily apparent and may be understood by referring to the following detailed description of an illustrative embodiment of the present invention, taken in conjunction with the accompanying drawings, where.

DESCRIPTION OF THE PREFERRED EMBODIMENTS

A circuit configuration is provided to obviate voltage spikes which occur at turn-off for each push-pull switch of an inverter circuit. Additionally, the circuit configuration is more efficient than conventional inverter circuit configurations.

Figure 5:
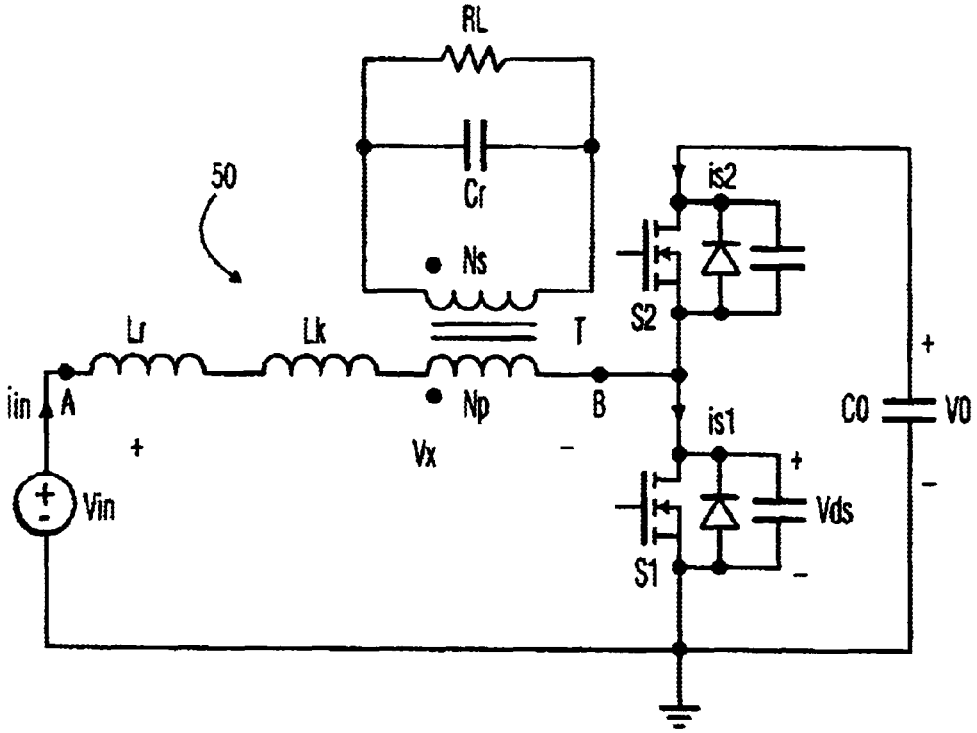
FIG. 5 is a circuit diagram illustrating an LCD backlighting inverter circuit in accordance with an embodiment of the present invention.

Turning now to FIG. 5, an exemplary schematic of the inverter circuit 10 displays one embodiment of the inventive circuit configuration connected to a load $R_L$. Load $R_L$ can be, but is not limited to a fluorescent lamp of the cold cathode type. The light from load $R_L$ can be used to illuminate a liquid crystal display (LCD) of a computer. Load $R_L$ is connected to a secondary winding of a transformer T. Transformer T includes one primary winding, $N_p$, and one secondary winding $N_s$. A resonant circuit is formed by a resonant inductor Lr and a resonant capacitor Cr. Other than resonant inductor Lr and resonant capacitor Cr, there is no other discrete inductor or capacitor included which substantially affects the resonant frequency of the resonant circuit. There is also no discrete ballasting element, typically a capacitor, in series with load $R_L$. The elimination of these discrete components from the resonant circuit or serially connected to the load $R_L$ reduces the parts count and cost of the inverter circuit 10.

Figure 6A:
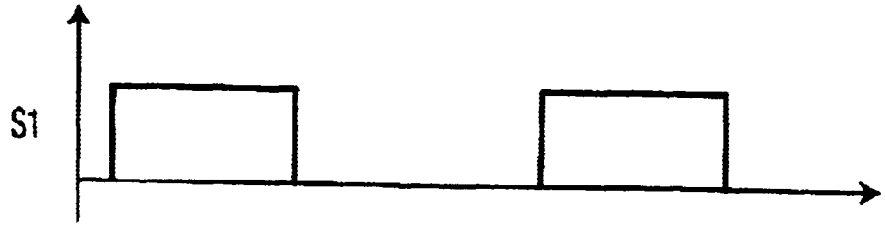
FIGS. 6*a*–6*d* illustrate representative waveforms present in the circuit of FIG. 5.
Figure 6B:
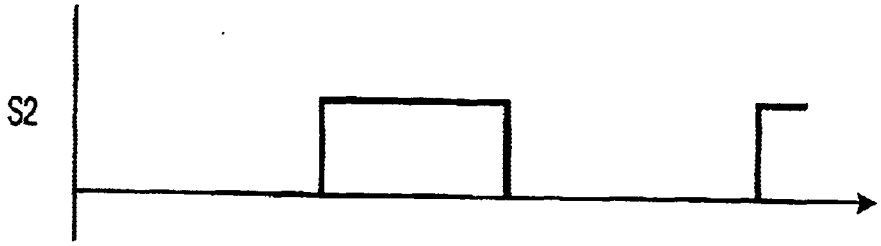

The half-bridge switching circuit (i.e., switching stage) includes switches S1 and S2. These switches are turned on and off by a drive control circuit (not shown). Switches S1 and S2 are never turned on at the same time and have ON time duty ratios of slightly less than 50% as shown in FIGS. 6A and 6B. A small dead time during which both switches are turned off is required to permit the zero voltage switching to be implemented. An output of the primary winding $N_p$ of the transformer T is connected to a midpoint connection terminal of the half-bridge switching circuit (See point B in FIG. 5). A clamping capacitor $C_o$ is connected in parallel with the half-bridge switching circuit. The inverter circuit 10 is sourced by a 12 V DC power supply, i.e., a battery, connected to one side of a resonant inductor Lr.

The circuit arrangement shown in FIG. 5 operates as follows. When switch S1 turns on during a first half-switching cycle (S1 on/S2 off), the input voltage $V_{in}$ is applied to terminals A and B of a resonant tank. That is, $V_x=V_{in}$. During this first half switching cycle, inductor Lr stores energy to be released in the next (i.e., second) half switching cycle (S1 off/S2 on).

During the second half switching cycle (S1 off/S2 on). The voltage difference between the input voltage, $V_{in}$, and capacitor voltage, $V_o$, is applied to the terminals A and B of the resonant tank. It will be shown that the capacitor voltage, equals nominally twice the input voltage, ($2*V_{in}$), during the second half switching cycle assuming a duty ratio of nominally 0.5 for the half-bridge switch configuration. In accordance with standard circuit analysis, it is shown that a voltage ($-V_{in}$) is applied to terminals A and B of the resonant tank during the second half switching cycle. In sum, the voltage across the resonant tank 50, i.e., terminals A and B, during the respective half-cycles equals Vin and −Vin, respectively. This is in contrast to the prior art circuits of FIG. 4 in which the voltage across the resonant tank 50 is $\frac{1}{2}*V_{in}$ to $-\frac{1}{2}*V_{in}$, respectively.

Figure 6C:
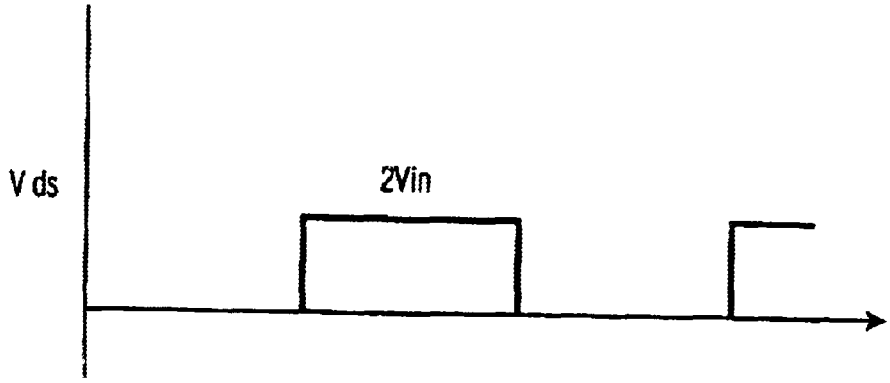
Figure 6D:
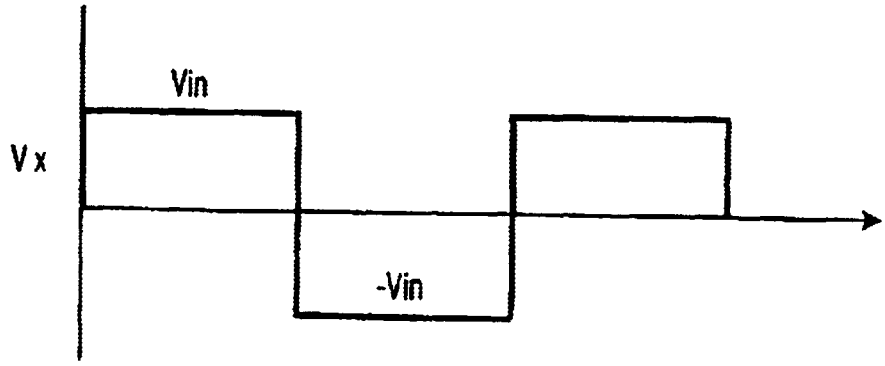

FIGS. 6*a*–6*d* illustrate typical switching waveforms associated with the inverter circuit 10 of FIG. 6. Referring first to FIGS. 6*a* and 6*d*, as stated above, for a first-half switching cycle (S1 on/S2 off), the voltage across the resonant tank 50, $V_x$, equals $V_{in}$, (See FIG. 6*d*).

It is well known in the art that for proper steady state operation, the average voltage across the terminals A and B of the resonant tank 50 must be near zero, otherwise the resonant inductor $L_r$ and transformer T will saturate. Given that the average value of $V_x$ must be a zero or near zero value, the average value of $V_{ds}$, the body diode voltage of switch S1, must equal the average value of $V_{in}$. During the second half switching cycle (S1 off/S2 on), $V_{ds}$ reaches a peak value of $2*V_{in}$, as shown in FIG. 6*c*. This peak voltage is realized in part to the circuit being configured to provide a boost function. Specifically, a portion of the energy stored in inductor Lr during the first half switching cycle is released during the second half switching cycle. This released energy is captured and maintained by clamping capacitor Co. The voltage on Co is further supplemented by the input voltage Vin to achieve the peak value $2*V_{in}$ during the second half switching cycle. It is noted that the capacitance value chosen for clamping capacitor Co is such that the peak voltage is maintained over multiple cycles.

Given that the average voltage across $V_x$ must be zero or near zero over a full cycle and recalling that $V_x=V_{in}$ for the first half-cycle, $V_x$ must therefore equal $(-V_{in})$ the second half cycle to maintain a zero or near zero value over a full cycle. During the second half-switching cycle (i.e., S2 on/S1 off) the circuit voltages of the inverter circuit 10 can be stated as:

$$V_{in}=V_x+V_0 \quad \text{Eq. 1}$$

which can be re-written as:

$$V_x=V_{in}-V_0 \quad \text{Eq. 2}$$

Equation (2) states that the tank excitation voltage, $V_x$, is the difference between the input voltage, $V_{in}$, and the clamping capacitor voltage. As described above, during this second half-cycle the capacitor voltage can be stated as $$V_0=2*V \quad \text{Eq. 3}$$

Substituting Eq. (3) into Eq. (2) yields:

$$\begin{aligned} V_x &= V_{in}-(2*V_{in}) \\ &= -V_{in} \end{aligned} \quad \text{Eq. 4}$$

Voltage $V_x$ for the second half cycle is illustrated in FIG. 6*d*.

Figure 1:
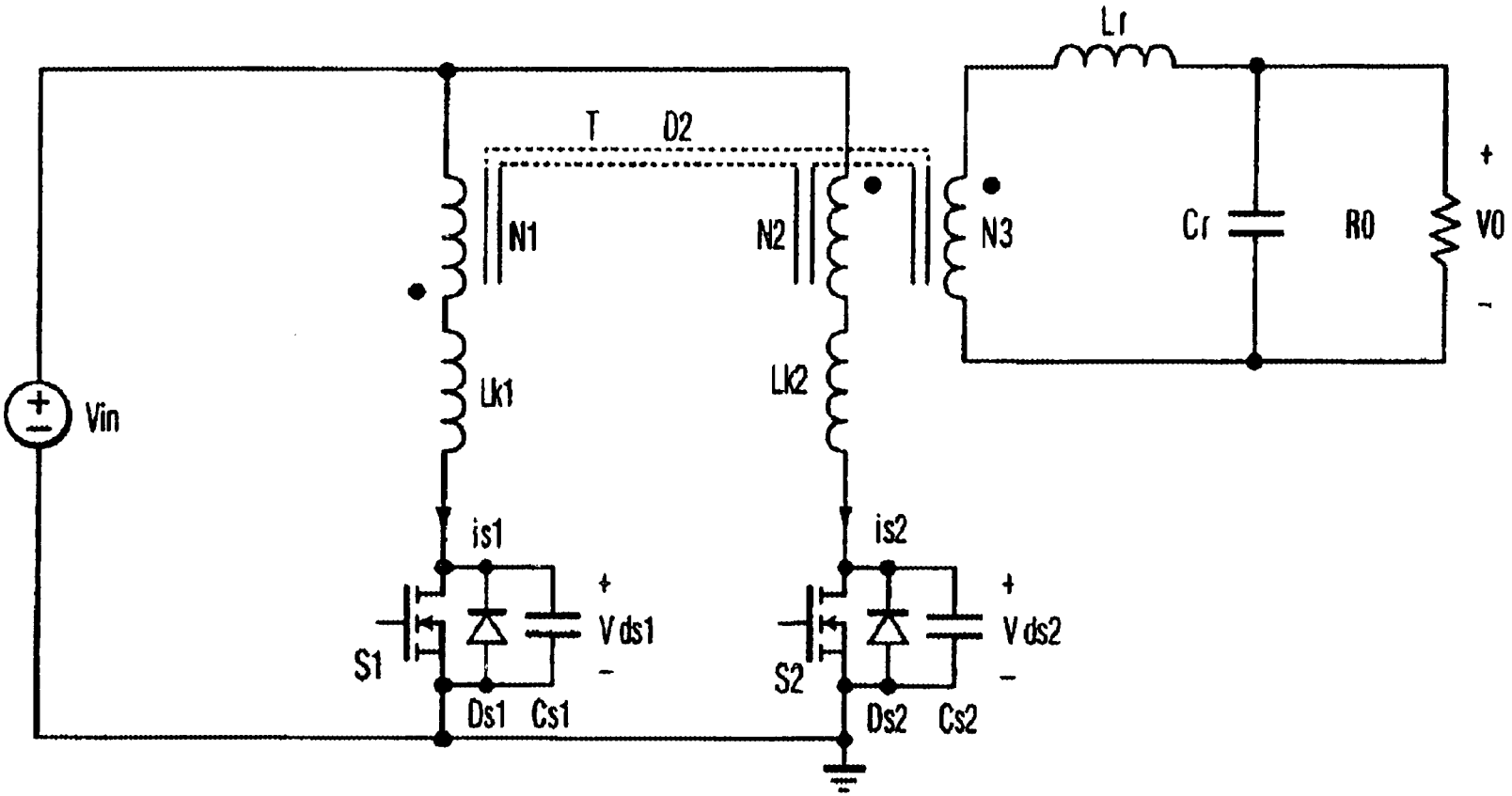
FIG. 1 (PRIOR ART)
FIG. 1 is a circuit diagram illustrating an LCD backlighting inverter circuit of the prior art.
Figure 2A:
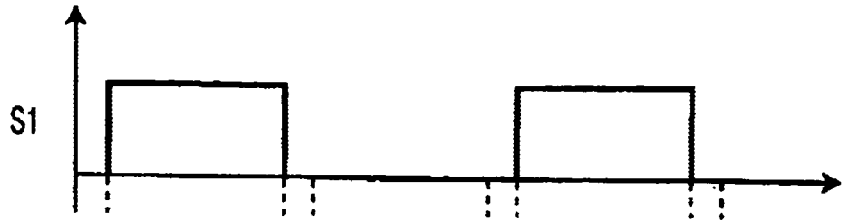
FIG. 2a (PRIOR ART)
FIGS. 2*a*–2*d* illustrate representative waveforms present in the circuit of FIG. 1.
Figure 2B:
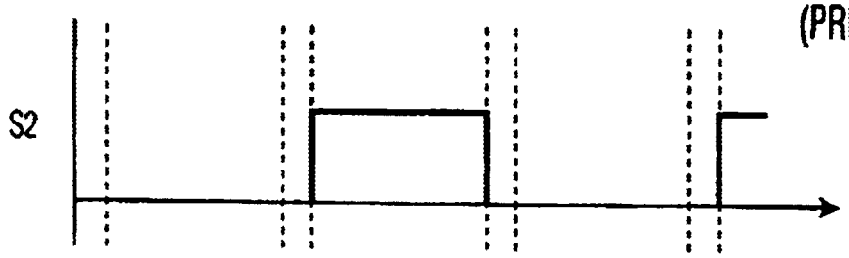
FIG. 2b (PRIOR ART)
Figure 2C:
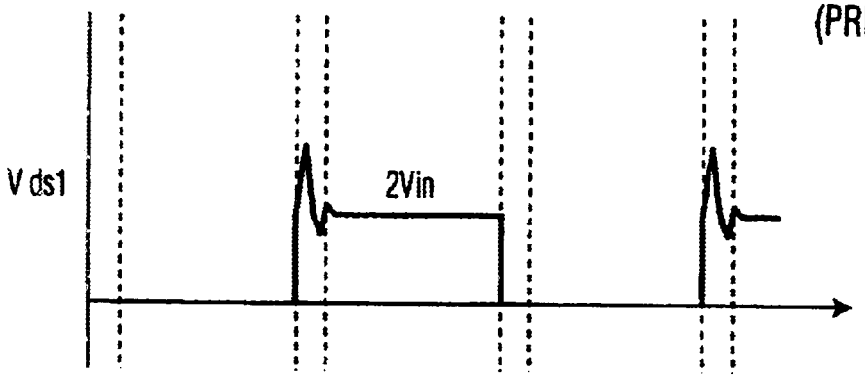
FIG. 2c (PRIOR ART)
Figure 2D:
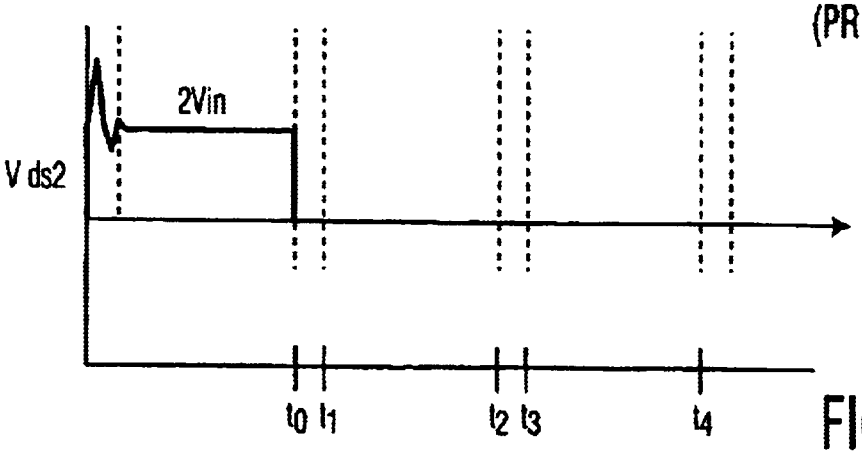
FIG. 2d (PRIOR ART)
Figure 3:
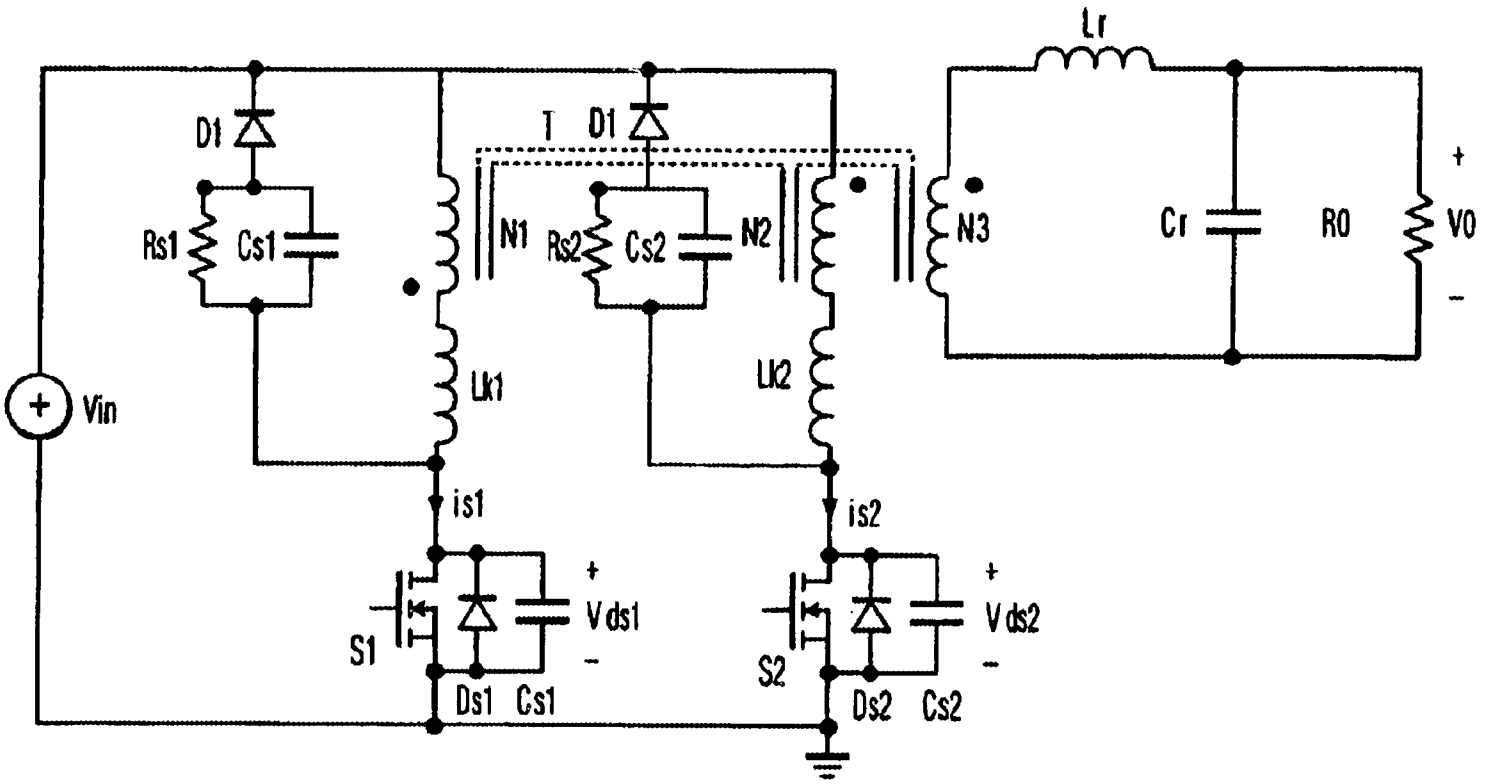
FIG. 3 (PRIOR ART)
FIG. 3 is a circuit diagram illustrating an LCD backlighting inverter circuit of the prior art.
Figure 4:
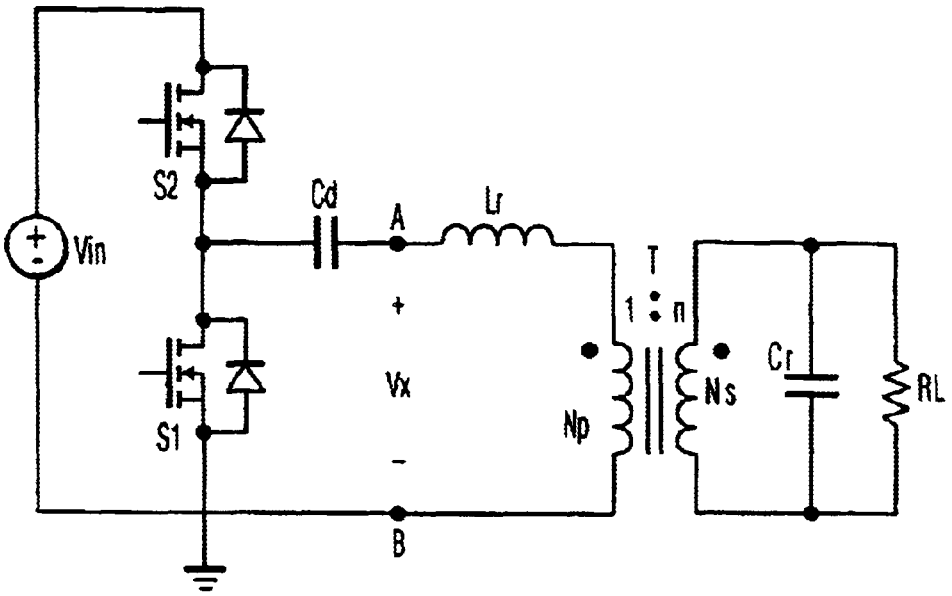
FIG. 4 (PRIOR ART)
FIG. 4 is a circuit diagram illustrating an LCD backlighting inverter circuit of the prior art.

It is appreciated that the average tank excitation voltage of the inventive circuit is twice that of the prior art circuit of FIG. 4. As a result, the required turns ratio of the transformer T is reduced by half. Correspondingly, the leakage inductance is significantly reduced thereby improving the overall efficiency of the circuit. In addition, the maximum voltage across the half-bridge switches is clamped by the capacitor voltage, Vo, and given as:

$$Vo=V_{in}/(1-D) \quad \text{Eq.5}$$

where D is the duty ratio of switch S1, which is nominally 0.5. A further advantage of circuit 10 is that unlike the prior art circuits where the leakage inductance is dissipated by a snubber network contributing to circuit inefficiency, the circuit 10 of the present invention recovers the leakage energy by utilizing a boost feature.

Figure 7:
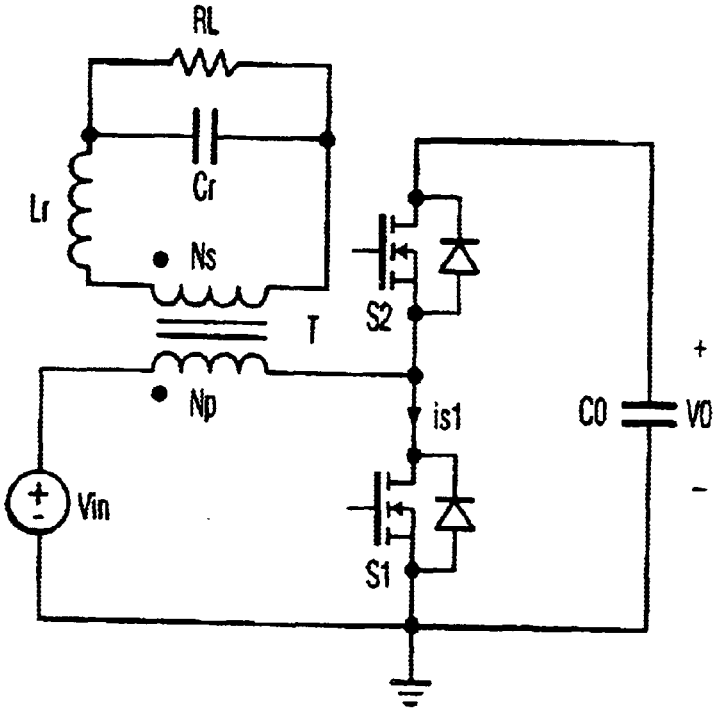
FIG. 7 is a circuit diagram illustrating an LCD backlighting inverter circuit in accordance with an embodiment of the present invention.
Figure 8:
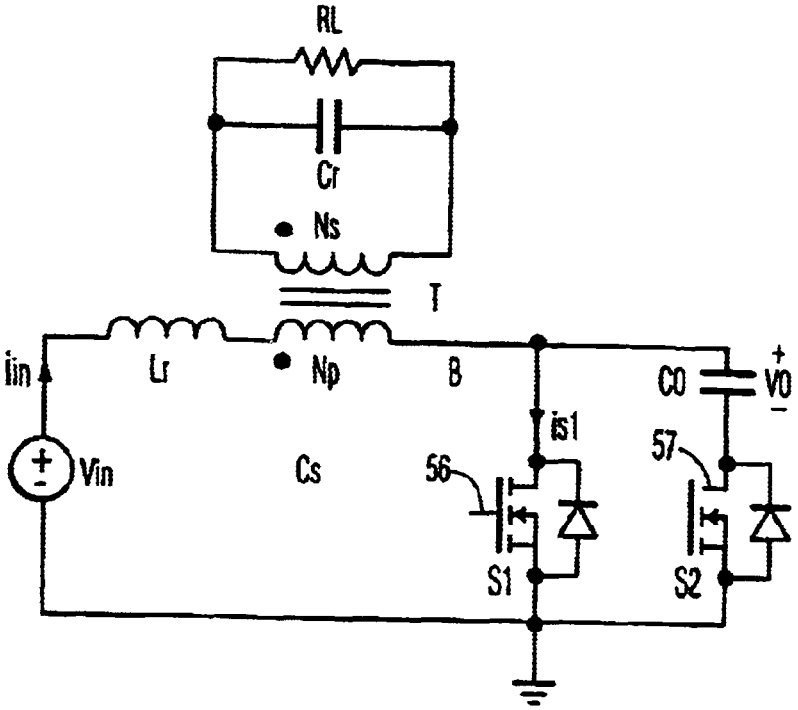
FIG. 8 is a circuit diagram illustrating an LCD backlighting inverter circuit in accordance with an embodiment of the present invention.
Figure 9:
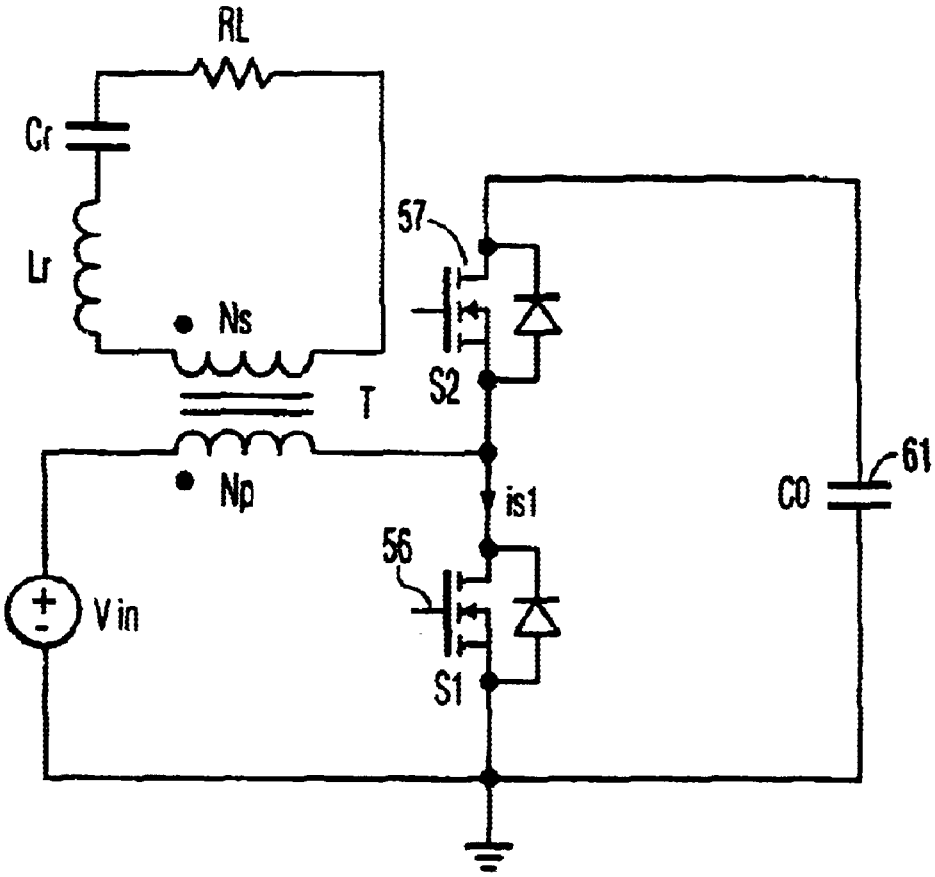
FIG. 9 is a circuit diagram illustrating an LCD backlighting inverter circuit in accordance with an embodiment of the present invention.

FIGS. 7–9 illustrate additional embodiments of the inventive circuit 10 in which the illustrated components have the same reference symbols as those in FIG. 6.

In FIG. 7, one embodiment of the inventive circuit 10 is shown in which the resonant inductor $L_r$ is shown in series with the resonant capacitor $C_r$ while the load is in parallel with the resonant capacitor.

FIG. 8 shows another embodiment of the inventive circuit 10. In this embodiment, switch S2 is a P-type MOSFET and further connected to the negative terminal of clamping capacitor $C_0$.

FIG. 9 shows another embodiment of the inventive circuit 10. In this embodiment, the resonant inductor $L_r$ is shown in series with the resonant capacitor $C_r$ in the load circuit.

In sum, the inventive circuit configuration provides advantages which are not achievable with the prior art circuit configurations discussed above. A first advantage realized by the inventive circuit is a higher efficiency due in part to the leakage inductance being a part of the resonant inductance. Specifically, the leakage inductance energy is fully recovered by virtue of being a part of the resonant inductance thereby precluding the need for a snubber circuit as used in the prior art. A second associated advantage is that the voltage across the half-bridge switches is reduced because of the energy recovery. As a consequence of the low turns ratio, the associated leakage inductance is minimized. A third associated advantage is that in addition to the leakage energy being recoverable it is also reduced as a consequence of the transformer having a lower turns ratio (i.e., one-half the conventional turns ratio). The lower turns ratio is achievable because the inventive circuit tank excitation voltage is twice that of a conventional excitation voltage.

We claim:

1. An inverter circuit for driving a gas discharge lamp load in a load circuit, said inverter circuit comprising:

a primary circuit including a DC voltage supply, a transformer including a primary winding and a secondary winding for coupling said primary circuit to the load circuit, and a switching circuit having a first switch and second switch for controlling a conduction state of said inverter circuit, wherein said primary winding is connected to a midpoint connection terminal of said switching circuit;

a tank circuit including a resonant inductor within said primary circuit, and a resonant capacitor coupled to the lamp load; and a capacitor coupled to said first switch and said second switch for maintaining a voltage across said primary winding.

2. The inverter circuit of claim 1, wherein said resonant inductor is coupled in series with said primary winding of said transformer.

3. The inverter circuit of claim 1, wherein said primary circuit further includes said capacitor.

4. An inverter circuit for driving a gas discharge lamp load in a load circuit, said inverter circuit comprising:

a primary circuit including a DC voltage supply, a transformer including a primary winding and a secondary winding for coupling said primary circuit to the load circuit, and a switching circuit having a first switch and second switch for controlling a conduction state of said inverter circuit, wherein said primary winding is connected to a midpoint connection terminal of said switching circuit;

a tank circuit including a resonant capacitor and a resonant inductor, wherein the lamp load is coupled in series with said resonant capacitor and said resonant inductor; and a capacitor coupled to said first switch and said second switch for maintaining a voltage across said primary winding.

5. The inverter circuit of claim 4, wherein said primary circuit further includes said capacitor.

6. An inverter circuit for driving a gas discharge lamp load in a load circuit, said an inverter circuit comprising:

a primary circuit including a DC voltage supply, a transformer including a primary winding and a secondary winding for coupling said primary circuit to the load circuit, and a switching circuit having a first switch and second switch for controlling a conduction state of said inverter circuit, wherein said primary winding is connected to a midpoint connection terminal of said switching circuit;

a tank circuit including a resonant inductor and a resonant capacitor, the lamp load being coupled to said resonant capacitor; and a capacitor coupled to said first switch and said second switch for maintaining a voltage across said primary winding, wherein said resonant inductor provides a boost function to said capacitor.

7. The inverter circuit of claim 6, wherein said primary circuit further includes said resonant inductor.

8. The inverter circuit of claim 7, wherein said resonant inductor is coupled in series with said primary winding of said transformer.

9. The inverter circuit of claim 6, wherein said primary circuit further includes said capacitor.

10. A method of eliminating voltage spikes in an inverter circuit for a gas discharge lamp, said method comprising:

providing a primary circuit including a DC voltage supply, a switching circuit having a first switch and a second switch for controlling a conduction state of the inverter circuit, and a transformer having a primary winding connected to a midpoint connection terminal of said switching circuit;

providing a tank circuit having a resonant inductor and a resonant capacitor, the lamp load being coupled with the resonant capacitor; and providing a capacitor coupled to the first switch and the second switch for maintaining a voltage across the primary winding; and providing a boost function by the resonant inductor to the capacitor.

11. A method of eliminating voltage spikes in an inverter circuit for a gas discharge lamp, said method comprising:

providing a primary circuit including a DC voltage supply, a switching circuit having a first switch and a second switch for controlling a conduction state of the inverter circuit, and a transformer having a primary winding connected to a midpoint connection terminal of said switching circuit;

providing a tank circuit having a resonant inductor and a resonant capacitor, the lamp load being coupled with the resonant capacitor; and providing a capacitor coupled to the first switch and the second switch for maintaining a voltage across the primary winding; and recovering leakage energy from the transformer in each of a plurality of switching cycles of the inverter circuit.

12. An inverter circuit for driving a gas discharge lamp load in a load circuit, said inverter circuit comprising:

a primary circuit including a DC voltage supply, a transformer including a primary winding and a secondary winding for coupling said primacy circuit to the load circuit, and a switching circuit having a first switch and second switch for controlling a conduction state of said inverter circuit;

a tank circuit including a resonant inductor within said primary circuit, and a resonant capacitor coupled to the lamp load; and a capacitor for maintaining a voltage across said primary winding, wherein said primary winding is connected to said first switch and said capacitor, and wherein said capacitor is coupled in series with said second switch.

13. The inverter circuit according to claim 12, wherein said resonant inductor is coupled in series with said primary winding.

14. The inverter circuit of claim 12, wherein said primary circuit further includes said capacitor.

15. An inverter circuit for driving a gas discharge lamp load in a load circuit, said inverter circuit comprising:

a primary circuit including a DC voltage supply, a transformer including a primary winding and a secondary winding for coupling said primary circuit to the load circuit, and a switching circuit having a first switch and second switch for controlling a conduction state of said inverter circuit;

a tank circuit including a resonant inductor and a resonant capacitor, the lamp load being coupled to sad resonant capacitor; and a capacitor for maintaining a voltage across said primary winding, wherein said primary winding is connected to said first switch and said capacitor, and wherein said capacitor is coupled in series with said second switch, and wherein said resonant inductor provides a boost function to said capacitor.

16. The inverter circuit according to claim 15, wherein said primary circuit includes said resonant inductor.

17. The inverter circuit according to claim 16, wherein said resonant inductor is coupled in series with said primary winding.

18. The inverter circuit of claim 17, wherein said primary circuit further includes said capacitor.

* * * * *